US007125079B1

(12) United States Patent
Lee et al.

(10) Patent No.: US 7,125,079 B1
(45) Date of Patent: Oct. 24, 2006

(54) PORTABLE SEATING DEVICE

(75) Inventors: Gordon J. Lee, Moorhead, MN (US); Cristobal Molina, Dilworth, MN (US); Paul J. Lee, Chesterfield, MO (US); David L. Carlson, Fargo, ND (US)

(73) Assignee: Integrated Systems, Moorhead, MN (US)

( * ) Notice: Subject to any disclaimer, the term of this patent is extended or adjusted under 35 U.S.C. 154(b) by 126 days.

(21) Appl. No.: 10/465,802

(22) Filed: Jun. 19, 2003

(51) Int. Cl.
*A47C 1/16* (2006.01)

(52) U.S. Cl. ..... 297/353; 297/284.7; 297/130; 297/352

(58) Field of Classification Search ..... 297/130, 297/284.7, 344.26, 352, 353, 378.1, 378.12, 297/440.22
See application file for complete search history.

(56) References Cited

U.S. PATENT DOCUMENTS

| | | | | |
|---|---|---|---|---|
| 1,852,012 | A * | 4/1932 | Hose | 297/344.26 |
| 2,508,769 | A * | 5/1950 | Osbon et al. | 297/252 |
| 2,734,556 | A * | 2/1956 | Hebrank | 297/230.1 |
| 3,112,956 | A * | 12/1963 | Schick et al. | 297/219.1 |
| 3,994,529 | A | 11/1976 | Lippert | 297/252 |
| 4,592,570 | A * | 6/1986 | Nassiri | 297/378.12 |
| 4,730,871 | A | 3/1988 | Sheldon | 297/230 |
| 4,781,413 | A | 11/1988 | Shumack | 297/252 |
| 4,981,325 | A * | 1/1991 | Zacharkow | 297/284.1 |
| 5,069,503 | A | 12/1991 | Martinez | 297/54 |
| 5,297,848 | A * | 3/1994 | Grinnell | 297/219.1 |
| 5,516,193 | A | 5/1996 | Simpson | 297/252 |
| 5,580,130 | A | 12/1996 | Williams | 297/352 |
| 5,730,688 | A * | 3/1998 | Prusick | 297/353 |
| 5,904,398 | A * | 5/1999 | Farricielli | 297/378.12 |
| 5,975,632 | A * | 11/1999 | Ginat | 297/284.7 |
| 6,343,837 | B1 | 2/2002 | Gage | 297/250.1 |
| 6,378,947 | B1 * | 4/2002 | Barber et al. | 297/284.7 |
| RE37,927 | E | 12/2002 | Fitch | 297/344.21 |
| 6,502,902 | B1 | 1/2003 | Romero | 297/352 |
| 6,513,876 | B1 * | 2/2003 | Agler et al. | 297/378.12 |
| 2002/0140265 | A1 | 10/2002 | Davis | 297/352 |

* cited by examiner

*Primary Examiner*—Peter R. Brown
(74) *Attorney, Agent, or Firm*—Marsh Fischmann & Breyfogle LLP

(57) ABSTRACT

The present invention relates to a portable seating device (e.g., portable stadium seat) that includes a seat and a backrest movably interconnected with the seat, and that is generally positionable in both stowed and deployed positions. The backrest also may be selectively movable toward and/or away from the seat, at least when the device is in the deployed position. One embodiment of the device may include a base that is interfacable with a supporting surface on which the device is to be supported, and a mechanism for rotatably interconnecting the seat with the base. Accordingly, the seat may be rotatable relative to the base. Another embodiment of the device may include a stand having a first end that is detachably interconnectable with the seat and/or base, and a second end that may be spaced from the base and interfacable with the supporting surface on which the device is to be supported.

38 Claims, 9 Drawing Sheets

PORTABLE SEATING DEVICE

FIELD OF THE INVENTION

The present invention generally relates to seating devices and, more particularly, to a portable seating device usable under multiple seating conditions, such as in conjunction with a bench-style or hard seating system.

BACKGROUND OF THE INVENTION

Many spectator event facilities (e.g., stadiums) are equipped with bench-style or bleacher seating (hereafter "bleachers") instead of individual seats. Regardless of the various materials utilized to construct these bleachers, sitting on these bleachers for extended periods of time can be extremely uncomfortable. Moreover, the lack of a backrest on these bleachers may tend to strain and/or aggravate the upper and/or lower back. Further, while some spectator event facilities are equipped with individual seats having backrests, these individual seats tend to be made of metal, hard plastics and/or wood, which have also tended to contribute to similar user discomfort and/or aggravation. As a result, many people desiring to attend spectator events have foregone such attendance due to the discomfort and/or physical demands associated with sitting on bleachers or hard seats. Moreover, such user discomfort/aggravation has also been associated with sitting on bench-style or hard seats associated with picnic tables, boats, hunting stands (e.g., for deer hunting), and the like.

Several attempts have been made to reduce/diminish the discomfort associated with bench-style and/or hard seating systems, such as those associated with spectator event seating. In the simplest attempt, portable cushions have been carried by individuals to be placed on the hard wooden, metal, or plastic surface of the seating system. While these cushions may address the pain of sitting on the hard surface (at least to a limited extent), they do not address strain on the upper and lower back. In another attempt, a portable seat combined with a backrest has been utilized to reduce/alleviate back pain/strain associated with bench-style and/or hard seating. More particularly, the most common design for these portable seats is a foldable seat that has both a seat portion and a backrest that are foldably connected. Although some of these portable seats have at least somewhat of a solid backrest, some of these portable seats are equipped with backrests that are extremely flimsy (e.g., provide a backrest in form, but not in substance) so that user back pain/strain is still a common occurrence. While some portable seats have provided limited substantive relief of back pain/strain associated with sitting in bleachers or the like, one of the costs associated with the same is that these portable seats tend to be extremely heavy, which may make them difficult to transport and/or even unusable for certain (e.g., elderly and/or physically weak) individuals. Therefore, it would be desirable to have a portable seat that is relatively light in weight to enhance its transportability, and further, that may be adjusted to better accommodate the needs/desires of the particular user.

SUMMARY OF THE INVENTION

In view of the foregoing, an objective of the present invention is to provide an improved portable seating device that eliminates or at least generally reduces the drawbacks of the above-mentioned conventional seats. More particularly, an important objective of the present invention is to provide an improved portable seating device that is conducive to back mechanics. Another important objective of the present invention is to provide an improved portable seating device that is capable of providing user-specific back support. Yet another objective is to provide a portable seating device that is easily adjustable and/or maneuverable. Still another important objective is to provide a portable seating that is light-weight and/or easy to transfer/carry. These objectives and additional advantages are generally realized by the present invention, which generally relates to a portable seating device, such as, for example, a portable stadium seat.

The portable seating device of the present invention generally includes a seat and a first backrest movably interconnected with the seat. Herein, "portable," "portability," and the like, generally refer to a characteristic of the seating device of the present invention which enables the same to be freely moved and/or easily/conveniently transported about by a potential user. Accordingly, the portable seating device may be said to be totable. In other words, a potential user may be able to carry a portable seating device of the invention with him/her "by hand," or by using an appropriate handle, shoulder strap, backpack, and/or carry-case. So, for example, "portable" may refer to the seating device weighing no more than about 10 pounds in one embodiment, no more than about 7 pounds in another embodiment, and no more than about 5 pounds in yet another embodiment.

Further, "movably interconnected," a "movable interconnection" or the like generally refers to the ability of at least one of the seat and the first backrest to be relocated relative to the other. This movably interconnection of the seat and the first backrest may be characterized as enabling the seating device to be one or more of folded, collapsed, compacted, packed, and the like. It may be said that this movable interconnecting relationship of the seat and the first backrest, at least in one embodiment, is a "pivotal interconnection," which herein generally refers to any type of interconnection that allows at least one of the seat and the first backrest to at least generally undergo a pivoting or pivotal-like motion relative to the other (e.g., due to at least one hinge or ball-and-socket type joint), including without limitation any interconnection that allows the same to move at least generally about a certain axis (e.g., via flexing or elastic deformation). Due to the movable interconnection between the seat and the first backrest, the portable seating device of the present invention is generally positionable in both a stowed (e.g., folded, collapsed, compacted, closed up, packed and/or the like) position and a deployed (e.g., unfolded, open, usable, employable and/or the like) position.

In a first aspect, the present invention is directed to the first backrest of the portable seating device being selectively movable at least one of toward and away from a reference plane that at least generally contains (or is even substantially aligned with) a seating surface of the seat, at least when the seating device is in the deployed position. Moreover, this first aspect is also characterized by a second backrest being both associated with and selectively movable relative to the first backrest.

Various refinements exist of the features noted in relation to this first aspect of the present invention. Further features may also be incorporated in this first aspect as well. These refinements and additional features may exist individually or in any combination. For instance, the second backrest may be selectively movable at least one of toward and away from the reference plane at least when the seating device is in the deployed position. Herein, "selectively movable," when referring to the first backrest, may generally refer to the first backrest being positionable in at least first and second positions. So, for instance, in one embodiment, at least when in the seating device is in the deployed position, the first backrest is generally disposed closer to the reference plane than when the first backrest is in the second position. As an example, when a particular user is sitting on the portable seating device, the first backrest may interface with the user's back at a first location when in the first position; and, by contrast, the first backrest may interface with the user's back at a second location that is "higher up" the user's back (relative to the first position) when in the second position. Moreover, "selectively movable," when referring to the second backrest, may generally refer to the second backrest being positionable in at least third and fourth positions relative to the first backrest. So, for example, when a particular user is sitting on the portable seating device, the second backrest may interface with the user's back at one location when in the third position; and by contrast, the second backrest may interface with the user's back at another location that is "higher up" the user's back (relative to the third position) when in the fourth position. Indeed, the second backrest associated with this first aspect may be typified as an adjustable lumbar pad or cushion in at least one embodiment. In one embodiment that has a pivotal interconnection between the seat and the first backrest, it may be said that at least one of the first and second backrests is selectively movable at least one of toward and away from the pivotal interconnection that movably interconnects the first backrest and the seat (at least when the portable seating device is in the deployed position). Regarding this movement and/or positioning of one or both the first and second backrests, it is preferred that the same can be accomplished by hand. Herein, "by hand" generally means without the use of a machine or tool.

Still referring to the first aspect of the present invention, the portable seating device may have a cover substantially disposed about both the first and second backrests. This cover may be characterized as housing a majority (and, in one embodiment, the substantial entirety) of both of the first and second backrests. At least in one embodiment, this cover may be said to at least assist in maintaining a position of the second backrest relative to the first backrest. This position maintenance function of the cover may be due to the cover being designed to at least generally bias at least one of the first and second backrests toward the other. This biasing at least generally enables a frictional interface of sorts to exist between the first and second backrests that enables positional maintenance of the second backrest relative to the first. Accordingly, in one embodiment, to adjust a positioning of the second backrest, a user would simply loosen and/or remove at least a portion of the cover to expose at least a portion of one or both the first and second backrests. The second backrest can be positioned at a desired location relative to the first backrest, and the cover can be put back on and/or tightened to hold the desired position of the second backrest relative to the first. In another embodiment, the cover may be at least generally stretchable, so that the user may simply reach under the cover to move the second backrest to the desired location relative to the first.

The first backrest associated with the portable seating device of the first aspect may, at least in one embodiment, include a frame. This frame may be pivotally interconnected with the seat, and may include any appropriate frame material. However, due to desired the portable nature of the seating device, lighter frame materials may be preferable over heavier materials. The first backrest may be said to be movably interconnected with the frame. Accordingly, the first backrest may be selectively movable at least generally along (and relative to) the frame. So, in embodiments that may be characterized as having a first backrest that can be positioned in at least first and second positions, these first and second positions may correspond with respective first and second locations along the frame.

Along similar lines, one embodiment of the first backrest of the portable seating device of the first aspect may include at least one aperture configured so that at least one fastener (e.g., appropriate screws, bolts/nuts, pins and the like) associated with the second backrest is extendable through the aperture(s). Preferably, this fastener associated with the second backrest enables a person (e.g., a user) to adjust and/or position the second backrest relative to the first backrest by hand. The aperture(s) of the first backrest may be any appropriate configuration. For example, the aperture (s) may be at least one elongate channel or a plurality of apertures disposed in a substantially linear configuration. In an embodiment having the above-described channel(s), the second backrest may be characterized as being movable along these channel(s) relative to the first backrest.

A further feature that may be indicative of the portable seating device of the first aspect is that the first backrest (and thus, the second backrest associated therewith) may be detached from a remainder of the seating device and, therefore, capable of being utilized without the remainder of the seating device. In other words, the first backrest may be removed from the rest of the seating device and used to supplement/enhance the comfort and/or support provided by a separate seating system that is already equipped with a back, such as a chair or any type of transport seat (e.g., car seat, airplane seat, bus seat, train seat, boat seat). Preferably, this detachment of the first backrest from the remainder of the seat is accomplishable by hand. Moreover, the first backrest preferably is equipped with a mechanism that enables the same to be releasably interconnected with the separate seating system by hand. Examples of appropriate manners for associating the first backrest of the seating device with the separate seating system may include hooks, straps, Velcro® and the like.

Yet still referring to the first aspect of the present invention, the portable seating device may include a base that is interfacable with a support structure (e.g., a bench, bleacher, chair, the ground, or the like) on which the seating device is to be supported. Moreover, the seating device may include a mechanism for rotatably interconnecting the seat with the base. Accordingly, the seat of such an embodiment may be characterized as being rotatable or spinnable (at least to some extent) relative to the base. Herein, "rotatably interconnecting" or the like generally refers to an associative relationship that enables the seat to rotate (e.g., turn about an axis) relative to the base. While any mechanism capable of enabling a seat to rotate relative to a base may be appropriate for inclusion in this first aspect, at least one example of such an appropriate mechanism is disclosed in relation to a second aspect of the present invention described below.

In still another embodiment associated with this first aspect, the portable seating device may include a stand. This stand may be characterized as having a first end that is detachably interconnectable with the base. Moreover, the stand may also have a second end, generally opposite from the first end that may be said to be both spaced from the base and interfacable with a supporting surface (e.g., a floor or the ground) on which the seating device is to be supported when the first end is detachably interconnected with the base. Herein, "detachably interconnectable" generally refers to a capability of the stand to be coupled (e.g., attached or joined) with and/or decoupled (e.g., detached or separated) from the seat as desired over multiple occasions. Preferably, this detachable interconnection can be accomplished by hand (e.g., without the use of tools/machines). While any design/configuration of a stand that is detachably interconnectable with a seat of a seating device may be appropriate for inclusion in this first aspect, a particular example of at least one appropriate stand is disclosed in relation to a third aspect of the present invention described below.

Turning now to a second aspect of the present invention, the portable seating device of the second aspect generally includes a base, a seat that is rotatable relative to the base, and a first backrest. The seat associated with this second aspect generally has a seating surface and a bottom disposed substantially opposite of the seating surface. The bottom of this seat may be contained within or defined by an outer perimeter of the same. In addition, the portable seating device of the second aspect includes a swivel disposed between the seat and the base. More specifically, the swivel associated with this second aspect generally includes a plurality of bearings. Further, each of at least first and second bearings (of the previously mentioned plurality of bearings) is generally spaced from the outer perimeter of the bottom of the seat by no more than about 4 inches.

Various refinements exist of the features noted in relation to this second aspect of the present invention. Further features may also be incorporated in this second aspect as well. These refinements and additional features may exist individually or in any combination. For example, the swivel may include a post. In one embodiment, the post may extend into at least one of the seat and the base. The post associated with some embodiments of this second aspect may be characterized as being substantially annularly disposed about a rotational axis of the swivel. Moreover, in at least one embodiment, the swivel's plurality of bearings may be symmetrically disposed about the axial post or at least the rotational axis (e.g., in embodiments devoid of an post). Referring to the bearings associated with the second aspect of the present invention, at least one of the bearings may be characterizable as being in direct contact with both the base and the seat. In other words, the base and the seat may be oriented such that they "sandwich" the bearings between the same.

The first and second bearings associated with this second aspect are generally positioned so that they may provide a benefit of enabling the seat to easily rotate (relative to the base), even under heavy loads or when weight on the seating surface is unevenly positioned. Moreover, the positioning of the first and second bearings may at least generally promote a maintenance of a spacing between the base and the seat (e.g., under conditions of uneven weight disbursement on the seat). Still referring to these bearings, each of first and second bearings (as well as other bearings) may be spaced from the outer perimeter of the bottom of the seat by no more than about 3 inches in one embodiment, no more than about 2 inches in another embodiment, and even no more than about 1 inch in yet another embodiment. In another light, each of first and second bearings may be described as being spaced from the rotational axis of the swivel by at least about 3 inches in one embodiment, at least 4 inches in another embodiment, at least about 5 inches in another embodiment, and at least about 6 inches in still another embodiment. Still other characterizations may be appropriate for describing the peripheral positioning of at least the first and second bearings.

Still referring to the case of the second aspect of the present invention, the portable seating device may be equipped with a rotational lock. This rotational lock may be said to at least generally selectively prevent and allow rotation of the seat relative to the base. For example, in a "locked" position, the rotational lock may at least generally couple the base and the seat in such a manner that the seat cannot rotate relative to the base. Conversely, in an "unlocked" position, the rotational lock may be prevented from substantially inhibiting rotation of the seat relative to the base (and/or vice versa). While various designs and arrangements of rotational locks may be appropriately employed with regard to this second aspect of the present invention, a particular example of such an appropriate rotational lock is a locking pin or the like.

Yet still referring to the second aspect of the present invention, the base of the portable seating device may be said to be at least generally interfacable with a separate and distinct seating assembly (e.g., a bench, bleacher, chair, or the like) on which the seating device is to be supported. The portable seating device of this second aspect may include yet other refinements. For example, in one embodiment, the first backrest may be selectively movable at least one of toward and away from the seating surface (at least when the seating device is in the deployed position). The first backrest may even be characterized as being rotationally dependent upon on the seat relative to the base. That is, if the seat is rotated, the first backrest may be structurally required to rotate in chorus with the seat. In another embodiment, the portable seating device may include a stand that has a first end that is detachably interconnectable with the base. Moreover, the stand may also have a second end, generally opposite from the first end that may be said to be both spaced from the base and interfacable with a supporting surface (e.g., a floor or the ground) on which the seating device is to be supported when the first end is detachably interconnected with the base. Moreover, the stand may be rotatably immobile relative to and when detachably interconnected with the base. In other words, when the stand engages with the base, the stand may be prevented from rotating relative to the base. While any design/configuration of a stand that is detachably interconnectable with a base of a seating device may be appropriate for inclusion in this second aspect, a particular example of at least one appropriate stand is disclosed in relation to the third aspect of the present invention described below.

The above-mentioned third aspect of the present invention is directed to a portable seating device having a stand that includes first and second supports that are pivotally interconnected with one another, and first and second ends associated with each of the first and second supports. The first end of each of these first and second supports is detachably interconnectable with the seat. Moreover, the second end of each of the first and second supports is both spaced from the seat and interfacable with a supporting surface (e.g., the ground or a floor) on which the seating device is to be supported when the first end of each of the first and second supports is detachably interconnected with the seat.

Various refinements exist of the features noted in relation to this third aspect of the present invention. Further features may also be incorporated in this third aspect as well. These refinements and additional features may exist individually or in any combination. The stand may be detachably interconnectable with the seat. For example, the seating device preferably includes a mechanism for attaching and/or detaching the stand and the seat by hand (e.g., without the use of tools/machines). In one embodiment, the seating device may be designed so that the stand can simply be "snapped" into engagement with the seat. In other words, the seating device may be configured so that a press fit joint of sorts can be utilized to detachably interconnect the stand and the seat. A benefit of using such a press fit design is that the stand can generally be both attached to and detached from the seat by hand. Moreover, one or more mechanical fasteners may be utilized to detachably interconnect the stand and the seat (e.g., a locking pin, with or without the noted press fit connection). In one embodiment, the mechanical fastener(s) may extend through the stand and at least a portion of the seat. The seating device may be characterized as being equipped with a mechanism to enable the stand and a bottom of the seat to be detachably interconnected. At least in one embodiment, this mechanism (e.g., a receiving portion of the above-described press fit joint) is generally positioned (or positionable) within an outer perimeter of the bottom of the seat. That is, however the seat and the stand are detachably interconnected with one another, the entirety of the mechanism enabling the same may be located under (or even substantially concealed by) the seat.

Still referring to the stand associated with the third aspect of the present invention, the stand may be said to be collapsible. That is, the stand (at least in one embodiment) may be capable of being "folded" or the like, for example, to enhance ease of storing and/or transporting the same. Another embodiment may be characterized by each of the first and second supports having first and second legs. Stated another way, the stand may have at least four legs.

Yet still referring to the third aspect of the present invention, the portable seating device may include a base and a mechanism for rotatably interconnecting a seating portion of the seat with the base. Accordingly, the seating portion of such an embodiment may be characterized as being rotatable or spinnable (at least to some extent) relative to the base. Moreover, the stand is generally detachably interconnectable with the base of the seat in such embodiments. In another embodiment, the first backrest of the seating device of the third aspect may be selectively movable at least one of toward and away from the seating surface (at least when the seating device is in the deployed position).

The stand utilized by the third aspect may have at least one of the first and second supports be of a telescoping configuration (e.g., so that the first and/or second support may be extended or retracted to a desired length). This would allow the length of the first support, the second support, or both to be adjusted. One instance where this feature may be particularly desirable is where the portable seating device is being used on uneven ground. This may then be used to maintain the seat in at least somewhat of a horizontal position.

A fourth aspect of the present invention is directed to a portable seating device. This portable seating device includes a seat and frame, where the frame in turn includes first and second frame sections. The first frame section is mounted on the seat. The second frame section is movably interconnected with the first frame section so as to be movable between stowed/collapsed and deployed/expanded positions. The first and second frame sections further are disposed in a telescoping or telescoping-like fashion so that the length of the frame may be increased or decreased at least when the second frame section is in the deployed position. In this regard, a first backrest is interconnected with the second frame section. This first backrest is selectively movable by the telescoping action available between the first and second frame sections to change the vertical position of the first backrest when in its deployed position. This may then be used to adjust the position where the first backrest engages the back of an individual that is using the portable seating device.

Various refinements exist of the features noted in relation to this fourth aspect of the present invention. Further features may also be incorporated in this fourth aspect as well. These refinements and additional features may exist individually or in any combination. The first frame section may remain in a fixed position relative to the seat. The first and second frame sections may be disposed at least generally perpendicular to the seat in this instance or at any other desired angle. The second frame section may be disposed at least generally parallel with the seat when in its stowed position. The second frame section may be pivotally interconnected with the first frame section to allow for movement between the stowed and deployed positions.

The portable seating device of the fourth aspect may further include a base. The base may be disposed directly on an appropriate supporting surface (e.g., planar, continuous). In one embodiment, the lower surface of the seat and the upper surface of the base are separated by a space of no more than about ¼ inch. This base may include an upper base surface that at least generally projects away from this supporting surface when the base is disposed thereon, and further that is disposed no more than about 2.5 inches from the supporting surface in one embodiment. Therefore, the base has what many characterized as a low profile when disposed on the supporting surface. Furthermore, the base may be supported on the supporting surface so that it has a constant vertical position relative to the supporting surface. Stated another way, the base preferably does not "rock" when disposed on the supporting surface, regardless of where the load is applied on the base. This may be realized by having the portions of the base that interface with the supporting surface collectively define a perimeter having an area of at least about 144 in.$^2$ in one embodiment, and at least about 289 in.$^2$ in another embodiment. In one embodiment, the base is at least generally the same size as the seat (their respective outer perimeters).

The above-noted base that may be associated with the fourth aspect may include a planar bottom surface that interfaces with the supporting surface such that the base is stable when disposed on the supporting surface. The base could further include a bottom surface that is not planar, but where the lowest portions of the bottom surface are collectively disposed within a common reference plane. What may be characterized as low profile rails, feet, legs or the like could extend down from the base to engage the supporting surface. These rails, feet, legs or the like could be integrally formed with the base or could be detachably interconnected therewith.

In addition to the foregoing, any of the various features discussed above in relation to any of the first, second, and third aspects, as well as those to be discussed below in relation to the fifth aspect, may be used by this fourth aspect, individually or in any combination.

A fifth aspect of the present invention is directed to a portable seating device. This portable seating device includes a base. The base may be disposed directly on an appropriate supporting surface (e.g., planar, continuous). Those portions of the base that interface with the supporting surface collectively define a perimeter having an area of at least about 144 in.$^2$, and at least about 289 in.$^2$ in another embodiment. A seat is movably interconnected with this base (e.g., rotational motion, swiveling motion), and a frame is mounted on this movable seat. At least a portion of this frame is movable between stowed and deployed positions. A first backrest is interconnected with this movable portion of the frame so as to also be movable between stowed and deployable positions as well.

Various refinements exist of the features noted in relation to this fifth aspect of the present invention. Further features may also be incorporated in this fifth aspect as well. These refinements and additional features may exist individually or in any combination. In one embodiment, the center of the "support" region or area coincides with the center of the area defined by the perimeter of the seat. The base may be characterized as having an upper base surface. In one embodiment this upper base surface at least generally projects away from this supporting surface when the base is disposed thereon, and further is disposed no more than about 2.5 inches from the supporting surface. Therefore, the base has what may characterized as a low profile when disposed on the supporting surface. In one embodiment, a lower surface of the seat and an upper surface of the base are separated by a space of no more than about ¼ inch. Furthermore, the base may be supported on the supporting surface so that it has a constant vertical position relative to the supporting surface, regardless of where the load is applied on the base. Stated another way, the base preferably does not "rock" when disposed on the supporting surface.

The base of the subject fifth aspect may include a planar bottom surface that interfaces with the supporting surface such that the base is stable when disposed on the supporting surface. The base could further include a bottom surface that is not planar, but where the lowest portions of the bottom surface are disposed within a common reference plane. Low profile rails, feet, legs or the like could extend down from the base to engage the supporting surface. These feet, legs or the like could be integrally formed with the base or could be detachably interconnected therewith. In addition to the foregoing, any of the various features discussed above in relation to any of the first, second, third, and fourth aspects may be used by this fifth aspect, individually or in any combination.

A sixth aspect of the present invention is directed to a portable seating device. This portable seating device includes a seat and frame. At least a portion of the frame is collapsible to allow the frame to be moved between a stowed position and at least one deployed position. A first backrest is mounted on a collapsible portion of the frame. This first backrest is selectively movable relative to the seat to change the vertical position of the first backrest when the frame is in a deployed position. This may then be used to adjust the position where the first backrest engages the back of an individual that is using the portable seating device. Any of the various features discussed above in relation to any of the first, second, third, fourth, and fifth aspects may be used by this sixth aspect, individually or in any combination.

The various features discussed above in relation to any of the aspects of the present invention may be incorporated into any of the other aspects of the present invention as well, and in the manner noted herein. Moreover, various other refinements may be appropriately included in any of the aspects described above. For instance, the seat and base may be of any appropriate size, shape, configuration, and/or construction. The portable seating device also may be equipped with a beverage holder that is generally interconnected (or interconnectable) with the seating device (e.g., the seat). In one embodiment, this beverage holder may even be characterized as being retractable, so that it is at least generally concealed by the seat when in an inactivated condition and at least generally exposed for use (e.g., along side the seat) when in an active condition. Further, the portable stadium seat may include one or more storage compartments (e.g., associated with at least one of the backrest and the seat). So, for example, a backside of the first backrest may be equipped with a pocket or compartment. Moreover, the seat may have a storage compartment, at least a portion of which may even be disposed between the seating surface and the bottom of the seat so that the storage compartment may be at least partially disposed within the seat. As still another refinement, the portable seating device may be equipped with one or more apparatuses to at least generally assist in enabling a user to carry the portable seating device. Examples of appropriate carrying apparatuses may include things such as handles, shoulder straps, backpacks, carry-cases, and the like. As still yet another refinement, the portable seating device may include one or more mechanisms (e.g., hooks, straps, and the like) for releasably interconnecting the portable seating device with another separate and distinct seating system such as a bleacher seat, a folding chair, a chair, a picnic table, a boat seat, a kayak seat, a hunting stand, and others.

DETAILED DESCRIPTION

Figure 1:
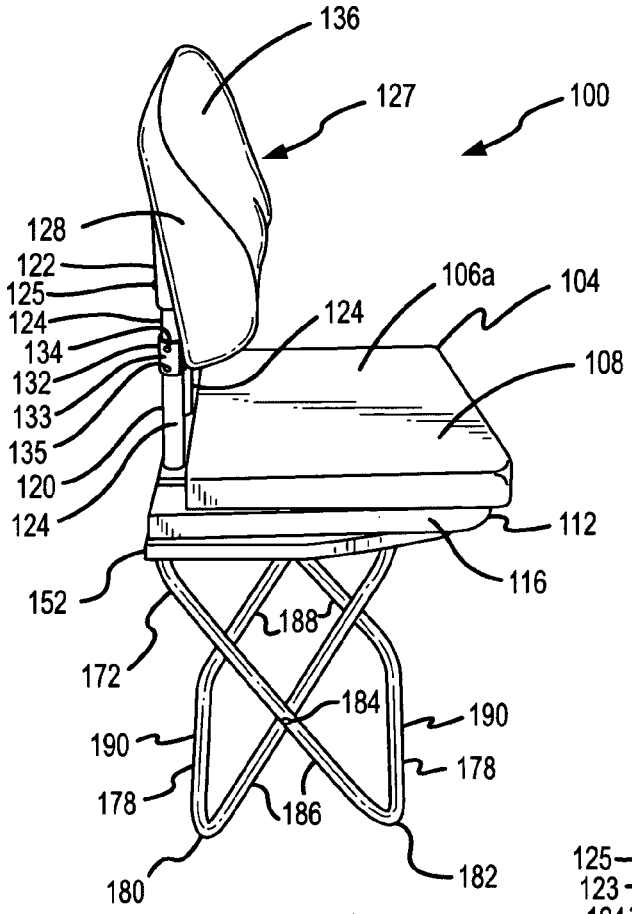
FIG. 1 is a side-based perspective view of one embodiment of a portable seating device.
Figure 2:
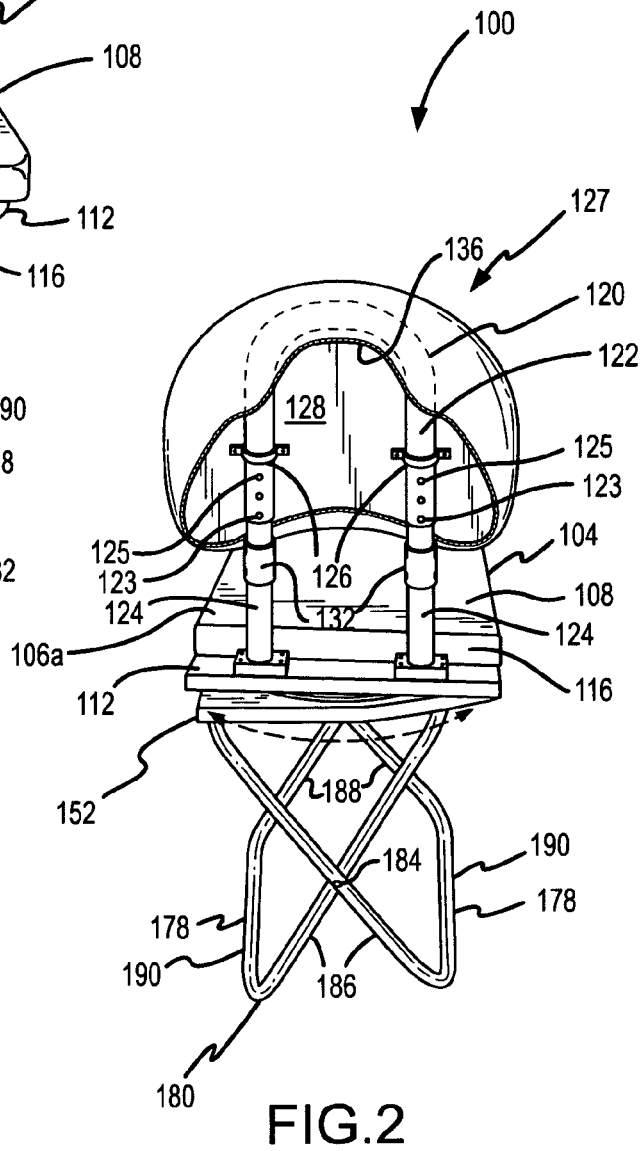
FIG. 2 is a back-based perspective view of the portable seating device of FIG. 1, and with its seat having been rotated relative to its base.

The present invention will now be described in relation to the accompanying drawings that at least assist in illustrating its various pertinent features. FIGS. 1–2 illustrate one embodiment of a portable seating device 100. Primary components of the portable seating device 100 are a seat 104 that is movably interconnected with a base 152, a stand 172 that is preferably detachably interconnected with the base 152 in any appropriate manner to dispose the seat 104 a desired distance above the subject supporting surface (e.g., a floor, the ground), a collapsible frame 120, and a backrest assembly 127 that is movably interconnected with the frame 120. The ability to detach the stand 172 from the base 152, along with the ability to collapse the frame 120 relative to the seat 104, contribute to the portability/transportability of the portable seating device 100. Various comfort-related features are included in the portable seating device 100. For instance, the seat 104 rotates or swivels relative to the base 152. Certain adjustment features are also provided in relation to the backrest assembly 127 to enhance an individual's comfort when using the portable seating device 100. The portable seating device 100 is also versatile in that it may reconfigured for the desired application (e.g., it is usable with the stand 172 or without the stand 172, for instance on a bleacher seat or the like). These and other desirable features of the portable seating device 100 will now be described in more detail.

Reference will now be made primarily to FIGS. 1–6 for a discussion of the configuration of the seat 104, frame 120, and backrest assembly 127. The seat 104 includes a cushion 108 and an upper seat surface 106*a*. The cushion 108 may be formed from any appropriate material and may be contoured in any appropriate configuration to enhance the comfort of an individual that is using the portable seating device 100. Preferably the cushion 108 is of a reduced weight so as to not adversely affect the portability of the portable seating device 100 to an undesired degree.

Another component of the seat 104 is a platform or bottom 112 that supports the cushion 108. The cushion 108 may be mounted on the platform 112 in any appropriate manner, including both a fixed and detachable mounting. In any case, preferably the relative movement between the cushion 108 and the platform 112 is limited to a compression of the cushion 108 by the weight of an individual using the portable seating device 100. That is, the cushion 108 and platform 112 in effect function as a single unit. The platform 112 may be formed from any appropriate material and may be of any appropriate configuration. In the illustrated embodiment the platform 112 is a solid plate-like structure. Preferably the platform 112 is of a reduced weight so as to not adversely affect the portability of the portable seating device 100 to an undesired degree.

The frame 120 provides an interface or interconnection between the seat 104 and the backrest assembly 127. The frame 120 includes one frame section in the form of an upper tube 122 (e.g., U-shaped in the illustrated embodiment) that is movably interconnected with another frame section in the form of a pair of lower tubes 124 so as to be able to vary the position of the upper tube 122 relative to the pair of lower tubes 124. The lower tubes 124 are fixed to the seat 104 in a stationary position. Therefore, movement of the upper tube 122 relative to the lower tubes 124 and seat 104 varies the location at which the backrest assembly 127 supports the back of an individual using the portable seating device 100. The frame 120 is also collapsible as will be discussed in more detail below to allow movement between a stowed or collapsed position and at least one deployed or expanded position. Other configurations of the frame 120 that provide this functionality may be utilized. The frame 120 also may be formed from any appropriate material. However, preferably the frame 120 is of a reduced weight so as to not adversely affect the portability of the portable seating device 100 to an undesired degree.

The upper tube 122 of the frame 120 includes a plurality of adjustment holes 123 on each of its two legs. Any appropriate number of adjustment holes 123 may be utilized. There is a telescoping relation between the upper tube 122 and the pair of lower tubes 124. In the illustrated embodiment, each lower tube 124 extends within the interior of the upper tube 122 and includes a compressible adjustment pin 125. Changing the vertical position of the upper tube 122 relative to the lower tubes 124 thereby simply requires compression of each adjustment pin 125 such that the upper tube 122 may be advanced relative to the pair of lower tubes 124 so as to dispose each adjustment pin 125 with a particular adjustment hole 123. The adjustment pins 125 may then be released to lock the position of the upper tube 122 relative to the pair of lower tubes 124.

Figure 3:
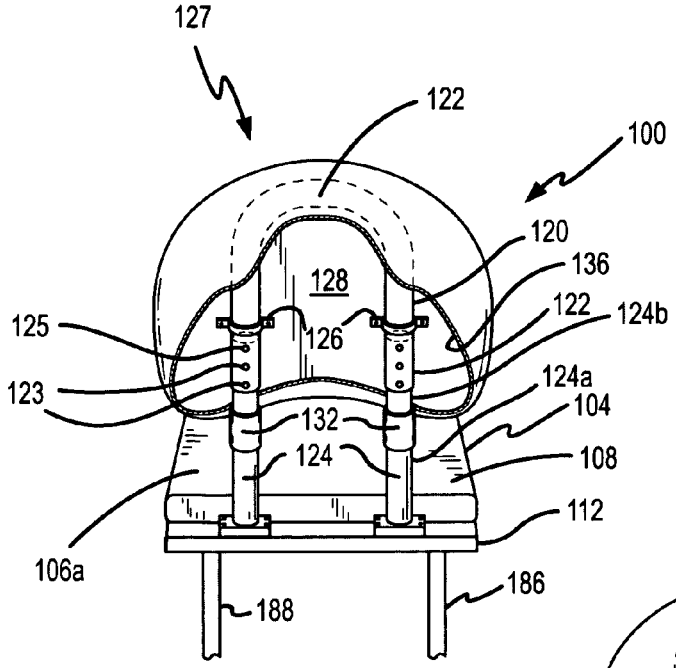
FIG. 3 is a back, perspective view of a portion of the portable seating device of FIG. 1, with its first backrest in a first vertical position.
Figure 4:
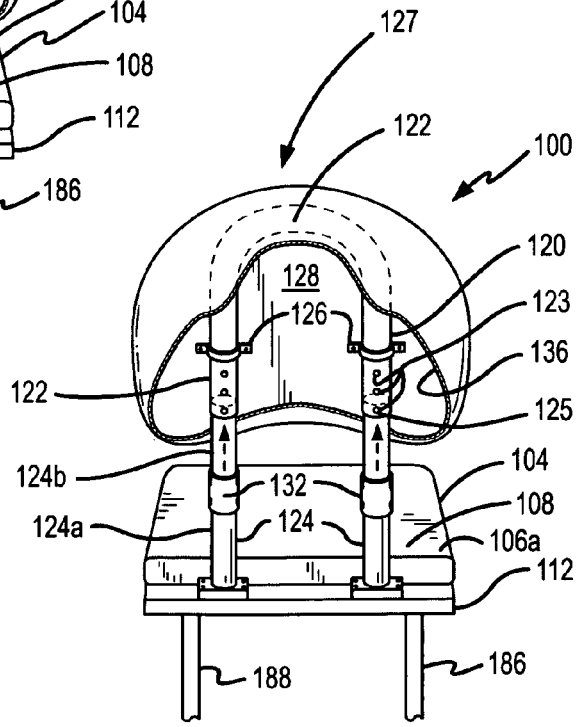
FIG. 4 is a back, perspective view of a portion the portable seating device of FIG. 1, with its first backrest in a second vertical position.

Each lower tube 124 further includes a pivotal connection 132 that separates the lower tube 124 into a first section 124*a* and a second section 124*b*, respectively (e.g., FIGS. 3–4). The first section 124*a* of each lower tube 124 is appropriately mounted on or anchored to the platform 112 of the seat 104. A second section 124*b* of each lower tube 124 interfaces with a corresponding leg of the upper tube 122. Each pivotal connection 132 includes a frame 133 (e.g., an at least generally U-shaped sleeve), a pivot pin 134 that extends through aligned holes in the frame 133, the first section 124*a*, and its corresponding second section 124*b*, and a removable locking pin 135 that extends through holes in the frame 133, the first section 124*a* and the corresponding second section 124*b* when properly aligned.

The backrest assembly 127 is movably interconnected with the seat 104 to support the back of an individual using the portable seating device 100 at a desired location. Various features are included in this backrest assembly 127 to enhance user comfort. The backrest assembly 127 includes a first backrest 128. Brackets or clamps 126 are used to mount the first backrest 128 on the upper tube 122 of the frame 120 in the illustrated embodiment. Any appropriate way of fixing the position of the first backrest 128 relative to the upper tube 122 of the frame 120 may be utilized. As such, the vertical position of the first backrest 128 is adjustable by movement of the upper tube 122 of the frame 120 relative to the pair of lower tubes 124 of the frame 120. The first backrest 128 may be formed from any appropriate material and may be contoured in any appropriate configuration to enhance the comfort of an individual that is using the portable seating device 100. Preferably the first backrest 128 is of a reduced weight so as to not adversely affect the portability of the portable seating device 100 to an undesired degree.

Figure 5:
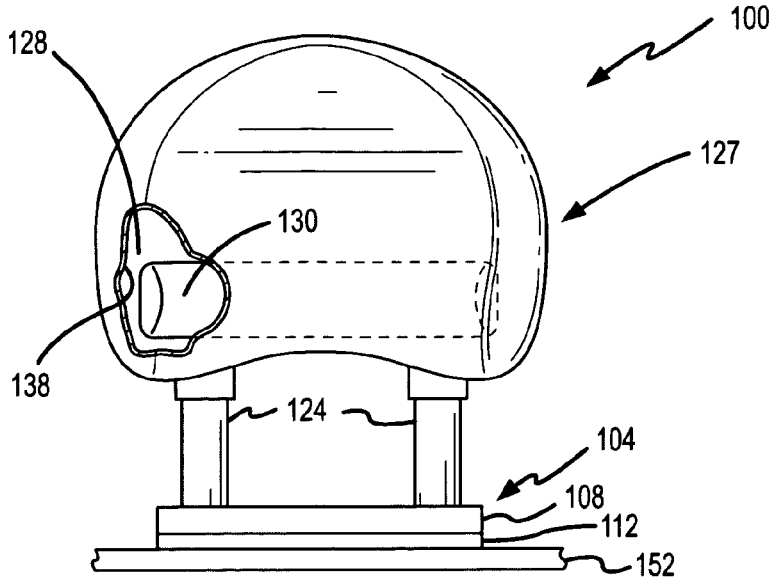
FIG. 5 is a front, perspective view of a portion of the portable seating device of FIG. 1, showing a cutaway of its cover to expose its second backrest, that is in a first vertical position relative to the first backrest.
Figure 6:
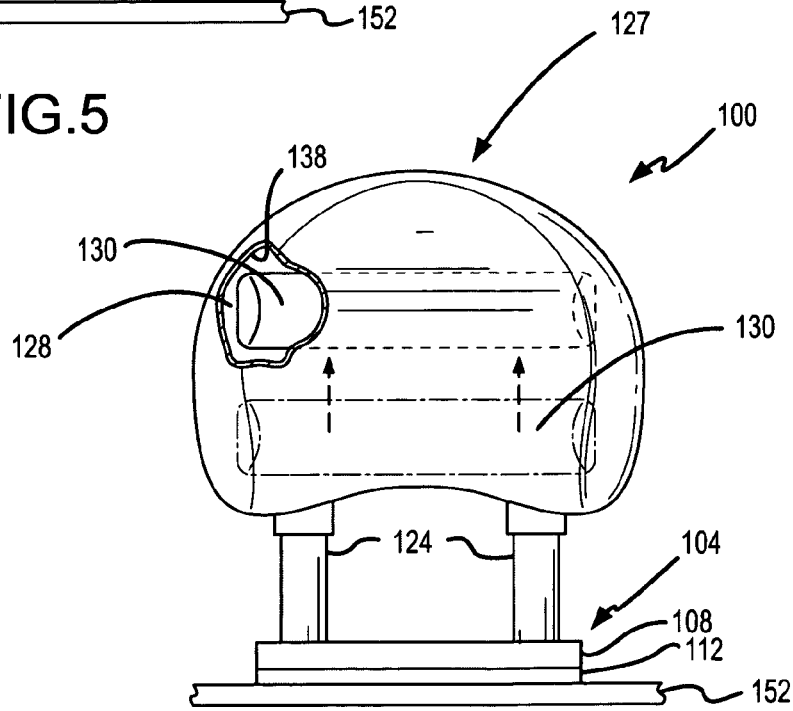
FIG. 6 is a front, perspective view of a portion of the portable seating device of FIG. 1, showing a cutaway of its cover to expose its second backrest, that is in a second vertical position relative to the first backrest.

The backrest assembly 127 further includes a second backrest 130 that is disposed against the surface of the first backrest 128 that faces the back of an individual that is using the portable seating device 100 (e.g., FIGS. 5–6). The position of the second backrest 130 may be adjusted relative to the position of the first backrest 128. One characterization of the second backrest 130 is that the same is a lumbar support or the like. In any case, the second backrest 130 may be formed from any appropriate material and may be contoured in any appropriate configuration to enhance the comfort of an individual that is using the portable seating device 100. Preferably the second backrest 130 is of a reduced weight so as to not adversely affect the portability of the portable seating device 100 to an undesired degree. More than one second backrest 130 could be utilized as well (not shown).

The cover 136 is disposed over both the first backrest 128 and the second backrest 130 to retain the second backrest 130 in a desired position relative to the first backrest 128. In one embodiment the cover 136 provides the sole mechanism for retaining the second backrest 130 in the desired position relative to the first backrest 128. However, the cover 136 may be used in combination with another mechanism of any appropriate type to provide this function (e.g., male/female Velcro® strips on the backrests 128, 130). The cover 136 may serve other appropriate functions, such as enhancing the aesthetics of the portable seating device 100 by including desired graphics or the like. Enhancement of the ability of the cover 136 to retain the second backrest 130 in the desired position relative to the first backrest 128 may be realized by forming the cover 136 from elastic or stretchable materials or the like. In this case, the position of the second backrest 130 relative to the first backrest 128 can be easily adjusted in any appropriate manner with the cover 138 partially or completely installed (e.g., grasping the second backrest 130 through the cover; disposing a hand under the cover 136 to directly engage the second backrest 130).

Figure 7:
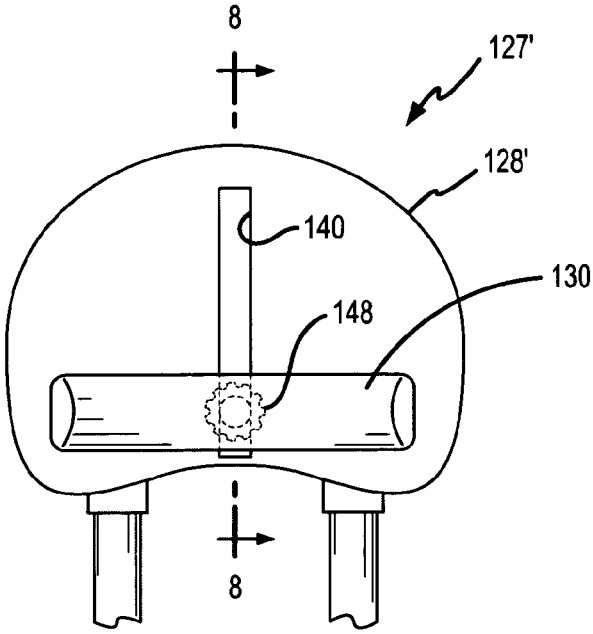
FIG. 7 is a front view of an alternative configuration of the first and second backrests used by the portable seating device of FIG. 1.
Figure 8:
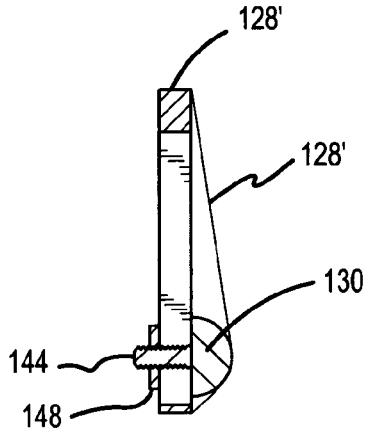
FIG. 8 is a cross-sectional view of the portable seating device of FIG. 7 through cut-line 8—8.

Another way to provide for adjustment of the position of the second backrest 130 relative to the first backrest 128 is illustrated in FIGS. 7–8. A "single prime" designation is used to identify components that differ in some respect from the embodiment of FIGS. 1–6. The backrest assembly 127' includes a first backrest 128' having an at least generally elongate channel or slot 140. Any number of slots 140 could be utilized. The vertical position of the second backrest 130 is adjustable relative to the first backrest 128' in the illustrated embodiment by embedding a stud 144 or the like in the second backrest 130 and directing this stud 144 through the slot 140 from the front side of the first backrest 128'. The stud 144 may be moved along the slot 140 to dispose the second backrest 130 in a desired vertical position relative to the first backrest 128'. Once in the desired vertical position, a nut 148 that is mounted on the stud 144 on the back side of the first backrest 128' may be rotated an appropriate amount to pull the second backrest 130 against the first backrest 128' and thereby retain the second backrest 130 in a fixed position relative to the first backrest 128'. The cover 136 could of course thereafter be positioned over the backrest assembly 127'. Another option would be for each stud 144 to also be threadably engaged with the first backrest 128'. This would allow not only the "up and down" position of the second backrest 130 to be adjusted relative to the first backrest 128' in the above-noted manner, but the distance that the second backrest 130 is disposed from the first backrest 128' along a line that is at least generally perpendicular to the first backrest 128' as well. That is, the amount that the second backrest 130 protrudes from the first backrest 128' may be adjusted. In this regard, at least two slots 140, as well as at least one stud 144 per slot 140 (i.e., more that one stud 144 could be provided per slot 140), may be utilized to interconnect the second backrest 130 with the first backrest 128'. This would provide enhanced stability, particularly for the case where the position of the second backrest 130 is adjusted to provide a space between the second backrest 130 and the first backrest 128'.

FIGS. 5–6 and FIGS. 7–8 illustrate two ways in which the position of the second backrest 130 may be adjusted relative to the first backrest 128. Other ways may be appropriate for providing this type of adjustment.

Based upon the foregoing, the backrest assembly 127 provides a number of desirable functions in relation to the portable seating device 100. One is that the vertical position of the first backrest 128 may be adjusted so that the first backrest 128 engages a desired location on the back of the individual using the portable seating device 100. Another characterization of this feature is that the vertical position of the first backrest 128 is adjustable relative to the seat 104. Compare the position of the first backrest 128 in FIGS. 3 and 4, where the arrows in FIG. 4 illustrate the direction in which the upper tube 122 and accompanying first backrest 128 were moved simultaneously from the position illustrated in FIG. 3 to adjust the vertical position of the first backrest 128 relative to the seat 104 to that illustrated in FIG. 4.

Another desirable function provided by the backrest assembly 127 is its ability to adjust the position of the second backrest 130 relative to the first backrest 128. Compare the position of the second backrest 130 in FIGS. 5–6, where the arrows in FIG. 6 illustrate the direction in which the second backrest 130 was moved from the position illustrated in FIG. 5 to that illustrated in FIG. 6. The second backrest 130 may be moved in any appropriate manner relative to the first backrest 128, and is preferably at least generally retainable in the adjusted position. Moreover, the second backrest 130 may be of any desirable shaped. Multiple second backrests 130 also may be utilized as noted (not shown).

Figure 9:
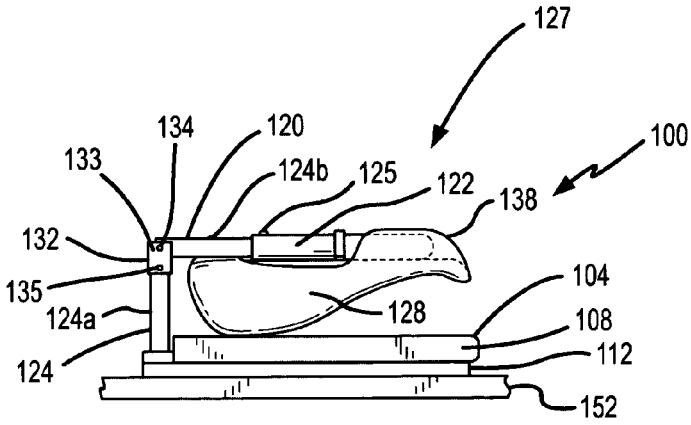
FIG. 9 is a side view of the portable seating device of FIG. 1 in a folded or stowed position.
Figure 10:
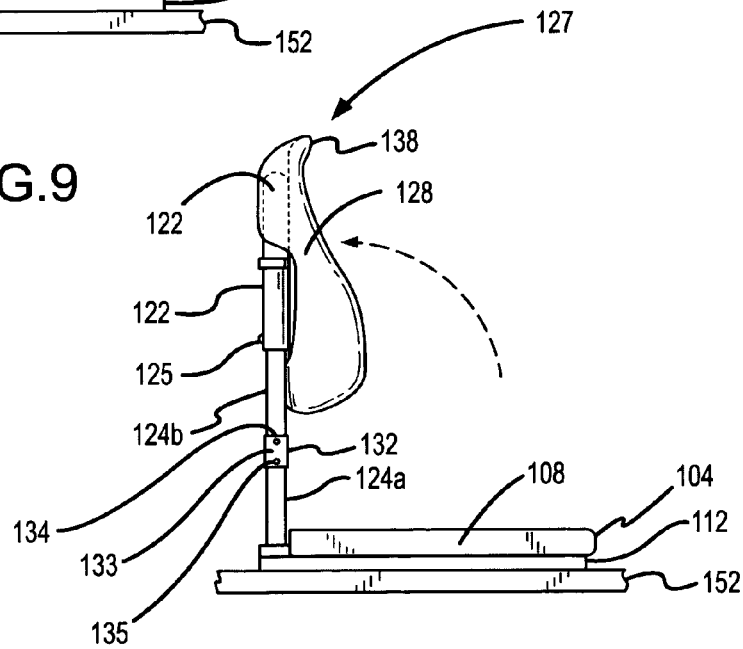
FIG. 10 is a side view of the portable seating device of FIG. 1 in an expanded or deployed position.

Yet another desirable function provided by the way in which the backrest assembly 127 is integrated with the portable seating device 100 is its ability to collapse to reduce the space consumed by the portable seating device 100 for storage and/or transport. This is illustrated in FIGS. 9–10. FIG. 9 illustrates a collapsed or stowed position for the backrest assembly 127. Here the first backrest 128 has been moved so as to contact the cushion 104 of the seat 104 or so as to be at least generally horizontally disposed. Another characterization of this position is that it disposes the upper portion of the frame 120 in at least generally parallel relation with the seat 104. In the illustrated embodiment, the lower section 124*a* of each lower tube 124 remains in a stationary position, while upper section 124*b* of each lower tube 124, along with the upper tube 122 and backrest assembly 127, pivots to an at least generally horizontal position or one where the upper section 124*b* of each lower 124 is disposed at least generally parallel with the seat 104.

FIG. 10 illustrates what may be characterized as a deployed or expanded position for the frame 120 and interconnected backrest assembly 127, where the upper portion of the frame 120 and the backrest assembly 127 have been moved at least generally away from the seat 104 in the direction of arrow. This disposes both the frame 120 and the first backrest 128 in at least somewhat of a vertical position. The frame 120 could be disposed at any desired angle in the deployed position. More than one deployed position could be available by appropriately configuring the frame 20. That is, the frame 120 and first backrest 128 could be disposed in what may be characterized as multiple angular positions relative to the seat 104. How the frame 120 and backrest assembly 127 are able to move between the two positions illustrated in FIGS. 9 and 10 is discussed above in sufficient detail and will not be repeated.

Support for the above-discussed seat 104 is provided by the base 152. The base 152 thereby must have sufficient structural strength so as to support an individual when using the portable seating device 100. However, the weight of the base 152 is preferably kept to at least somewhat of a minimum so as to not adversely affect the portability of the portable seating device 100 to an undesired degree.

Figure 11:
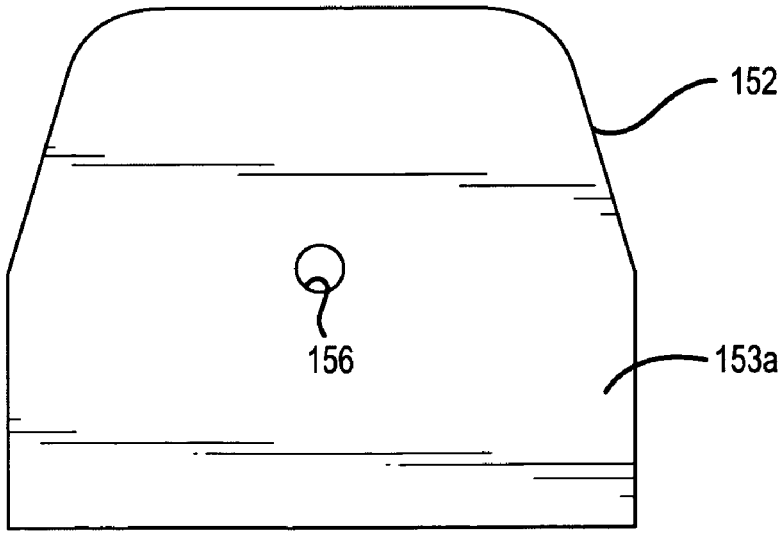
FIG. 11 is a top view of the base of the portable seating device of FIG. 1.
Figure 12:
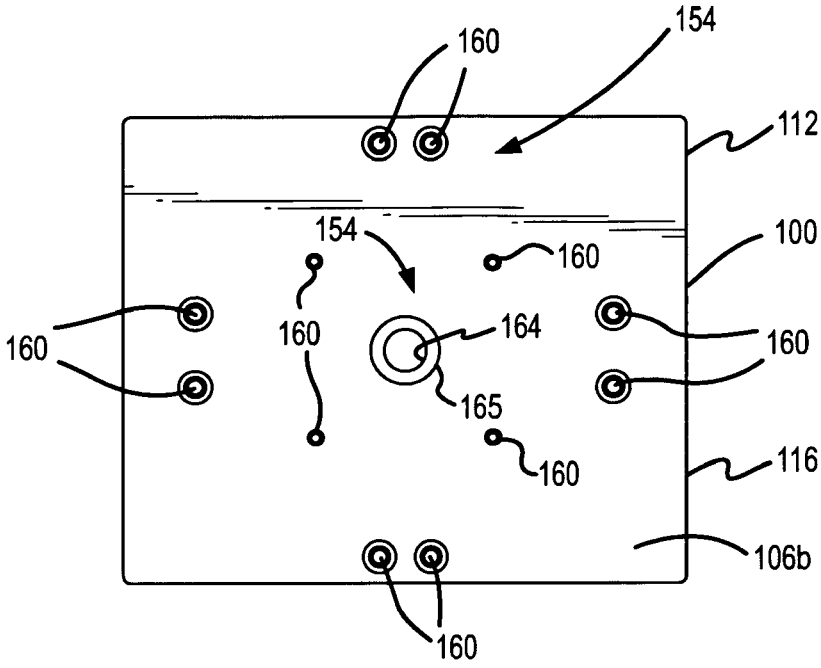
FIG. 12 is a bottom view of the seat of the portable seating device of FIG. 1.

Broadly speaking, the seat 104 is movably interconnected with the base 152. In the illustrated embodiment this is provided by disposing what may be characterized as a swivel 154 between the movable seat 104 and the stationary base 152 and which is illustrated in FIGS. 11–12. This swivel 154 allows the seat 104 to rotate or swivel relative to the stationary base 152 (e.g., in the direction indicated by the arrow in FIG. 2). Details regarding this swivel 154 are illustrated in FIGS. 11 and 12 as noted. Referring first to FIG. 11, the surface 153*a* of the base 152 that projects toward and/or interfaces with the seat 104 (an upper base surface 153*a*) includes an aperture 156 that extends all the way through the base 152. This aperture 156 in effect locates the axis about which the seat 104 will rotate or swivel relative to the base 152.

Referring now to FIG. 12, the surface of the platform 112 of the seat 104 that projects toward or interfaces with the base 152 includes a short post 164 or the like. This post 164 is part of the swivel 154 and is disposed within the aperture 156 of the base 152 in the assembled condition. The post 164 may include external threads to provide at least somewhat of an interlock between the seat 104 and the base 152. Other ways of interlocking the seat 104 and base 152 (or stated another way maintaining an assembled condition) could be utilized. In any case, rotation of the post 164 within the aperture 156 thereby allows the seat 104 to rotate or swivel relative to the base 152. Enhancement of this motion may be provided by utilizing a plurality of the ball bearings 160 or the like that engage each of the platform 112 and the base 152, and that may be disposed in any appropriate arrangement. The ball bearings 160 need not be disposed equidistantly from the post 164. Stated another way, the various ball bearings 160 need not be positioned along a common arc. In the illustrated embodiment, a pair of ball bearings 160 are spaced inwardly from each of the four sides of the platform 112 generally at the midpoint thereof.

The various ball bearings 160 may be captured within an appropriate recess or the like formed on a lower seat surface 106*b* of the seat 104 that projects toward and/or interfaces with the base 152, more specifically its upper base surface 153*a*. Preferably these ball bearings 160 are able to rotate relative to the platform 112 of the seat 104, as well as relative to the base 152. The ball bearings 160 need not be "contained" in relation to their engagement with the upper base surface 153*a*, which is planar in the illustrated embodiment.

The ball bearings 160 are also preferably positioned to enhance the stability of the seat 104 on the base 152. One way to enhance this stability is to position at least one ball bearing 160 within about 4 inches, and more preferably within about 2 inches, of each of the four sides of the base 152. Preferably, a plurality of ball bearings 160 are disposed within the noted distance of the perimeter of the base 152 (e.g., at least one ball bearing 160 spaced inwardly from each "side" of the base 152). Another way to enhance the stability of the seat 104 on the base 152 is to position the center of all ball bearings 160 at least about 2 inches in one embodiment, and at least about 3 inches in another embodiment, from the center of the post 164. Both of these stability enhancing features are preferably used.

The aperture 156 associated with the base 152 may be threaded. The base 152 may then be threaded onto the threaded post 164 associated with the seat 104. The amount of resistance offered when rotating the seat 104 relative to the base 152 may be established by how far the base 152 is threaded onto the post 164. This in effect determines how "tightly" the ball bearings 160 are retained between the seat 104 and the base 152. Once the desired degree of rotational resistance is realized, a nut 165 may be threaded onto the end of the post 164 to complete the attachment of the base 152 and seat 104. A lock also may be provided to fix the position of the seat 104 relative to the base 152 (not shown) to so as to preclude relative rotation therebetween (e.g., a pin that would extend within/through the platform 112 of the seat 104 and the base 152).

Figure 13:
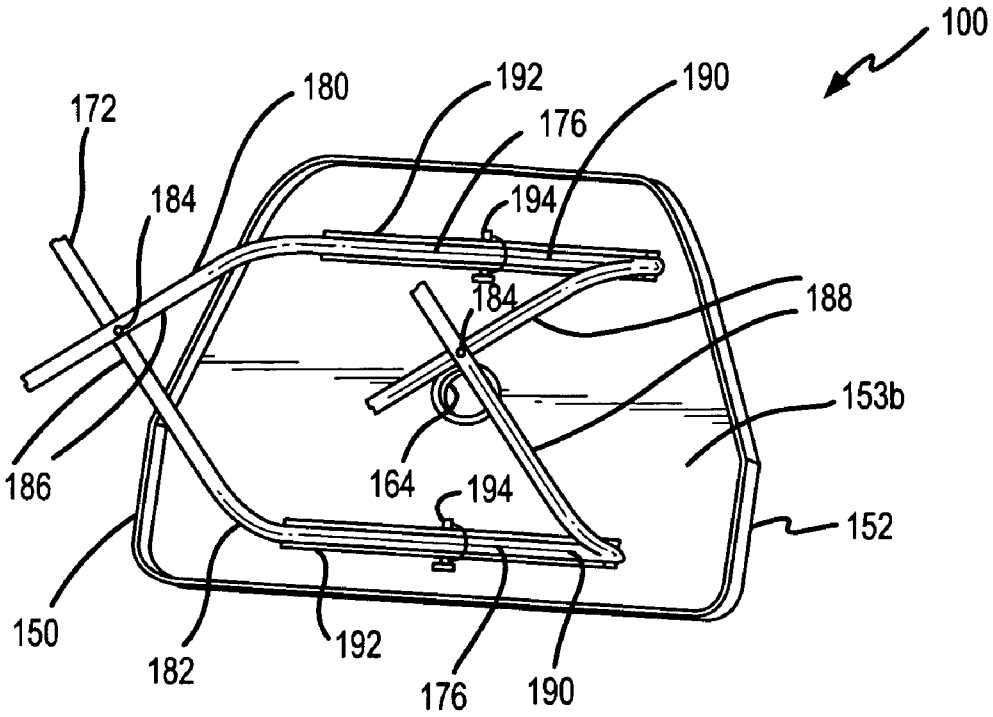
FIG. 13 is a bottom, perspective view of the portable seating device of FIG. 1.

The portable seating device 100 may be used in a "lawn chair" like application by using the above-noted stand 172. The stand 172 disposes the base 152 of the portable seating device 100 at a certain position above the relevant supporting surface (e.g., the floor, the ground). Reference may be made back to FIGS. 1–2, as well as FIG. 13 with regard to this particular application. This stand 172 may be characterized as having a first end 176 that interfaces with the base 152, as well as a second end 178 that interfaces with the relevant supporting surface. There are a number of key features in relation to the stand 172. One is that the stand 172 may be installed on and removed from the base 152 without the requirement of any tools. In one embodiment this is provided by utilizing a press fit or snap-lock 192 between the stand 172 and the base 152. This press fit or snap-lock 192 may provide the sole source for retaining the stand 172 relative to the base 152. However, other mechanisms may also be utilized (e.g., brackets). For instance, a locking pin 194 may be directed through aligned holes in the base 152 and the stand 172. Another desirable feature of the stand 172 is that it may be collapsed for enhancing the transport of the portable seating device 100 after its removal from the base 152. In any case, preferably the installation of the stand 172 on the base 152, as well as the removal of the stand 172 from the base 152, does not require any tools, and thereby may be done solely by hand. Any suitable configuration may be utilized for the stand 172 that provides the is type of desirable functionality.

There are two main components of the stand 172 in the illustrated embodiment, namely a first support 180 and a second support 182. These supports 180, 182 are pivotally interconnected by a pair of pivot pins 184. Each of the first and second supports 180, 182 include a pair of laterally spaced first and second legs 186, 188, as well as a pair of vertically spaced cross members 190. One cross member 190 from each of the legs 186, 188 thereby collectively define the first end 176 of the stand 172, while the opposite cross member 190 from each of the legs 186, 188 thereby collectively define the second end 178 of the stand 172.

Figure 14:
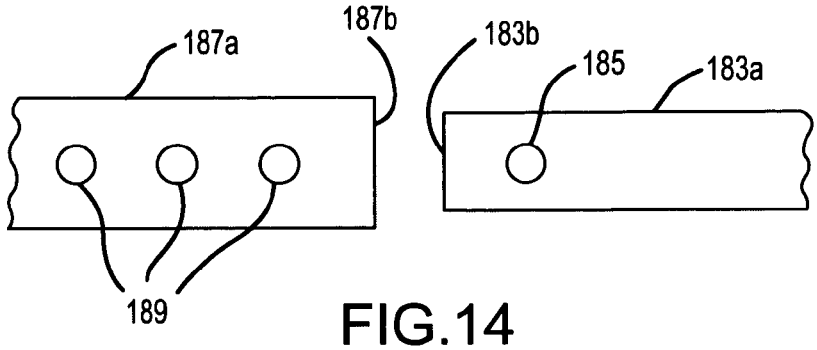
FIG. 14 is one embodiment for a telescoping structure that may be used by the stand of the portable seating device of FIG. 1, and which allows the length of this stand to be adjusted.

At least one of, and more preferably each of, the first support 180 and second support 182, are able to extend or retract to a desired length (i.e., to change the magnitude of the vertical spacing between the base 152 and the cross member 190 of the associated first support 180 or the second support 182). The first support 180 and/or the second support 182, specifically each of their respective legs 186, 188, may be configured in the manner illustrated in FIG. 14. Here, an inner tube 183*a* and an outer tube 187*a* are telescopingly engageable. The inner tube 183*a* includes an end 183*b* and a compressible/extendable locking pin 185 (e.g., spring biased to the extended position). The outer tube 187*a* includes an end 187*b* and plurality of adjustment holes 189. Any appropriate number of holes 189 may be utilized. The end 183 of the inner tube 183*a* is directed into the end 187*b* of the outer tube 187*b*, the pin 185 is depressed, and the inner tube 183*a* is advanced relative to the outer tube 187*a* to position the pin 185 associated with the inner tube 183*a* in alignment with the desired hole 189 on the outer tube 187*a*. Releasing the pin 185 will thereby lock the position of the inner tube 183*a* relative to the outer tube 183*b*. Changing which hole 189 the pin 185 interfaces with will of course change the length of the leg 186, 188 that uses the configuration of FIG. 14. Adjusting the length of one or both of the first support 180 and second sport 182 may be used to dispose the seat 104 in at least generally a horizontal position, even when the portable seating device 100 is being used on a sloping surface.

The portable seating device 100 provides a number of advantages over existing portable seating devices. One is the ability to adjust the vertical position of the first backrest 128 relative to the seat 104. Another is the ability to adjust the position of the second backrest 130 relative to the first backrest 120 to further enhance user comfort. That is, the position of the second backrest 130 may be adjusted without having to change the position of the first backrest 128. Including that swivel 154 to allow the seat 104 to rotate or swivel relative to the stationary base 152 allows an individual using the portable seating device 100 to turn and yet have the portable seating device 100 provide support for the individual's back.

The ability to remove the stand 172 from the base 152 and to be able to collapse the frame 120 enhances the portability of the portable seating device 100. In one embodiment, the volume of space occupied by the base 152, seat 104, and the backrest assembly 127 when the frame 120 is collapsed is relatively compact. Stated another way and in one embodiment, the portable seating device 100 in the position illustrated in FIG. 9 has a maximum length dimension (from the rear of the device 100 to its front) of no more than about 18 inches, a maximum width dimension of no more than about 18 inches (from one side of the device 100 to its opposite side), and a maximum height dimension of no more than about 12 inches. Relatedly, the portable seating device 100 is preferably light in weight. In one embodiment, the portable seating device 100 (without the stand 172) weighs no more than about 10 pounds in one embodiment, no more than about 7 pounds in another embodiment, and no more than about 5 pounds in yet another embodiment.

The portable seating device 100 is also very versatile in that the portable seating device 100 may be adapted to the needs for multiple seating applications. As noted above, the portable seating device 100 may be configured for a lawn chair-like application when the stand 172 is attached to the base 152. However, the portable seating device 100 also may be used without the stand 172. In this case the base 152 is disposed directly on an appropriate supporting surface, such as a bleacher, the ground, or the like. Certain features are incorporated into the design of the portable seating device 100 to accommodate this case where the stand 172 is not utilized, namely in relation to the stability of what may be characterized as a reconfigured portable seating device 100. One way to realize a desired degree of stability is for the seat 104 and base 152 to be at least generally of the same size (e.g., in relation to their respective outer perimeters). Another is the above-noted positioning of the bearings 160 relative to the axial post 164, both of which collectively define the swivel 154 between the seat 104 and the base 152. Moreover, preferably the upper base surface 153*a* is disposed no more than about 2.5 inches from the supporting surface when the base 142 is disposed directly on an appropriate supporting surface without the stand 172. In one embodiment, a lower seat surface 106*b* of the seat 104 and an upper base surface 153*a* of the base 152 are separated by a space of no more than about 14 inch. This thereby defines what may be characterized as a low profile for enhancing stability of the portable seating device 100.

The lower base surface 153*b* of the base 152 is also preferably configured such that it will not "rock" when disposed on a flat supporting surface, regardless of where the load is applied on the base 152. Stated another way, the lower base surface 153*b* is preferably configured such that the base 152 may be supported on a flat supporting surface so that the base 152 has a constant vertical position relative to this supporting surface. In any case, this may be provided by having the lower base surface 153*b* be at least generally planar (not shown), by having multiple low profile rails, feet, legs, or the like on this lower base surface 153*b*, or by having the lowest portions of the lower base surface 153*b* be disposed within a common reference plane and oriented to provided the desired stability. In this regard and for the case of the illustrated embodiment, the base 152 includes a rim 150 that is disposed about the perimeter of the base 152. The rim 150 defines the lowest extreme of the lower base surface 153*b*, and further is disposed in a common reference plane. The press-fit joint 192 does not extend beyond the distal end of the rim 150. The remainder of the lower base surface 153*b* could include a grid of ribs or the like that terminated at the same elevation as the lowest extreme of the rim 150 (not shown). In one embodiment, those portions of the base 152 that interface with the supporting surface when the base 152 is disposed directly thereon collectively define a perimeter having an area of at least about 144 in.$^2$, and at least about 289 in.$^2$ in another embodiment. Stated another way, the perimeter of the base 152 encompasses/defines an area of at least about 144 in$^2$. Preferably the center of this "support" region or area coincides with the center of the area defined by the perimeter of the seat 104.

Figure 15A:
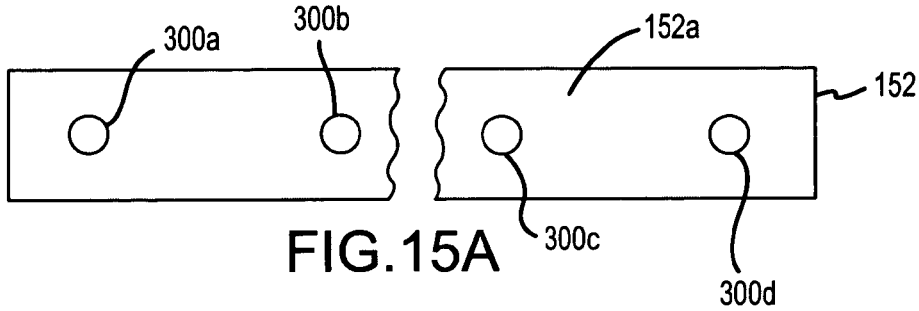
FIG. 15A is a front view of the base used by the portable seating device of FIG. 1, illustrating a plurality of holes that may be used to house a structure for securing the base to a bleacher or the like after the stand has been removed therefrom.
Figure 15B:
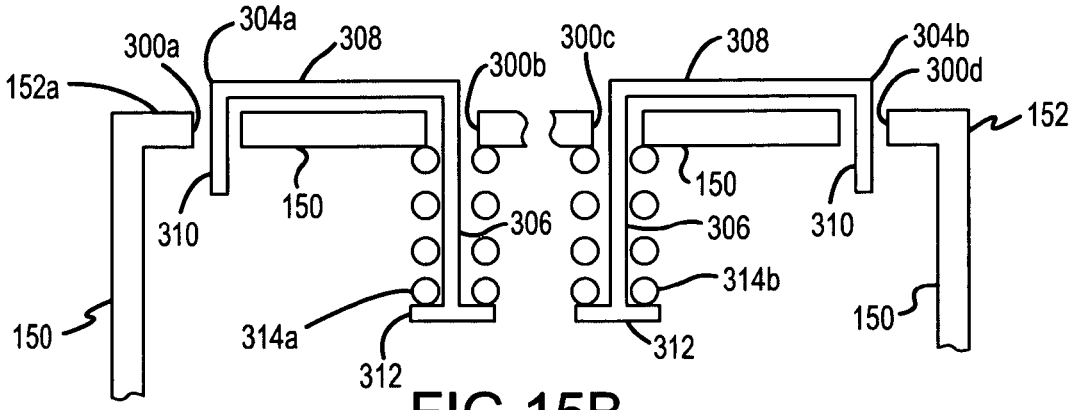
FIG. 15B is a bottom view of one embodiment of a structure for securing the base used by the portable seating device of FIG. 1 to a bleacher seat or the like, after the stand has been removed therefrom and with the securing structure being in the stowed position.
Figure 15C:
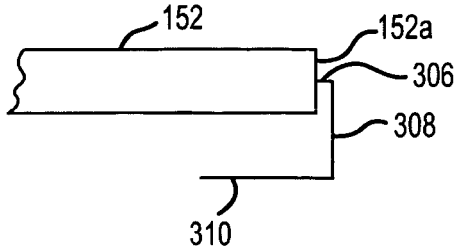
FIG. 15C is the securing structure of FIG. 15B in its deployed position.

The portable seating device 100 may include an appropriate structure for at least somewhat securing the base 152 to an appropriate support on which it may be disposed (e.g., a bleacher; a seat of a picnic table) with the stand 172 having been removed therefrom. One such structure is illustrated in FIGS. 15A–C. FIG. 15A illustrates a front face 152*a* of the base 152. Holes 300*a–d* extend at least within the base 152. In the illustrated embodiment and referring to FIG. 15B, the holes 300*a–d* extend through the rim 150 associated with the base 152 in the illustrated embodiment. In any case, one hook or clamp 304*a* interfaces with the holes 300*a*, 300*b*, while another hook or clamp 304*b* interfaces with the holes 300*c*, 300*d*. An appropriate biasing member 314*a*, 314*b* is associated with the corresponding clamp 304*a*, 304*b* (e.g., a coil spring).

Each clamp 304*a*, 304*b* includes a first section 306, a second section 308, a third section 310, and a stop 312. The first section 306 of the clamp 304*a* is disposed within hole 300*b*, the second section 308 of clamp 304*a* extends between the holes 300*a*, 300*b* on the exterior of the base 152, and the third section 310 of clamp 304*a* extends back within the hole 300*a*. The biasing member 314*a* is disposed between the stop 312 of the clamp 304*a* and the rim 150, and biases the clamp 314*a* into the stowed position of FIG. 15B. Similarly, the first section 306 of the clamp 304*b* is disposed within hole 300*c*, the second section 308 of clamp 304*b* extends between the holes 300*c*, 300*d* on the exterior of the base 152, and the third section 310 of clamp 304*b* extends back within the hole 300*d*. The biasing member 314*b* is disposed between the stop 312 of the clamp 304*b* and the rim 150, and biases the clamp 304*b* into the stowed position of FIG. 15B.

FIG. 15B illustrates the stowed position for the clamps 304*a*, 304*b*. In order to secure the base 152 to a bleacher or the like using the clamps 304*a*, 304*b*, the user simple pulls the clamps 304*a*, 304*b* out and away from the front face 152*a* of the base 152 so that the third section 310 of each clamp 304*a*, 304*b* is now disposed beyond the front face 152*a* of the base 152. This is done by compressing the biasing member 314*a* between the rim 150 and the stop 312 of the clamp 304*a*, and by compressing the biasing member 314*b* between the rim 150 and the stop 312 of the clamp 304*b* in the illustrated embodiment. The clamps 304*a*, 304*b* may then be rotated within their corresponding hole 300*b*, 300*c* to dispose the second section 308 of each clamp 304*a*, 304*b* in an at least generally vertical position. This then disposes the third section 310 in at least somewhat of a horizontal position, under the front portion of the base 152, and as illustrated in FIG. 15C. A bleacher or the like may then be disposed between the third section 310 of each clamp 304*a*, 304*b* and the bottom of the base 152. It should be appreciated that the clamps 304*a*, 304*b* could be disposed in the deployed position of FIG. 15C while the portable seating device 100, without the stand 172, already being positioned on the relevant surface.

Figure 16:
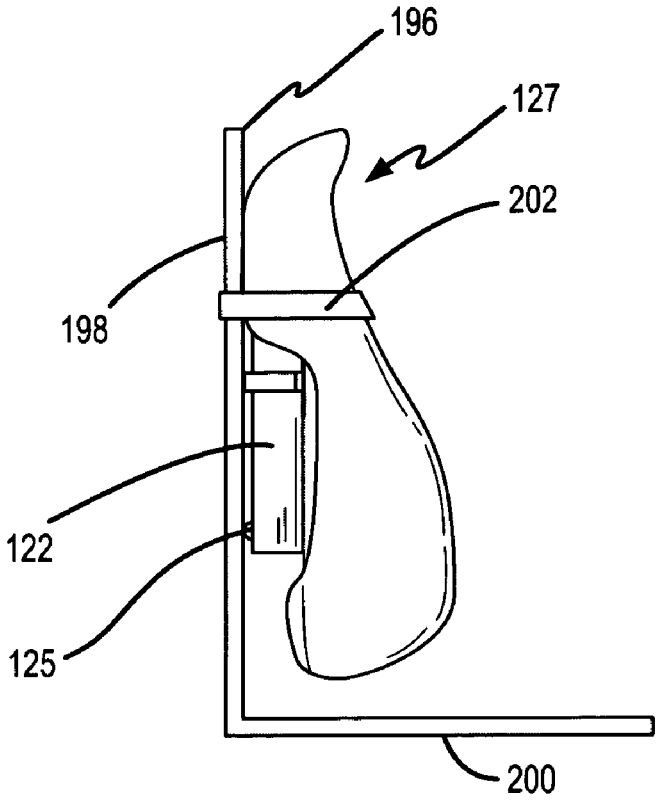
FIG. 16 is a side view of a portion of the backrest assembly of the portable seating device of FIG. 1, having been removed and positioned on a separate seating assembly.

There are yet other options for reconfiguring the portable seating device 100. The upper tube 122 of the frame 120 and the backrest assembly 127 may be removed from the remainder of the portable seating device 100 and used all by itself as a support for an individual's back. One example of this application is illustrated in FIG. 16. Here, a "chair" 196 has some type of back 198 and a seat 200. The backrest assembly 127 may be mounted on this back 198 in any appropriate manner, such as by using a strap 202. The upper tube 122 of the frame 120 and the backrest assembly 127 may be disposed between the user's back and any appropriate support.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A portable seating device, comprising:

a seat assembly comprising a rotatable seat, that in turn comprises a seating surface;

a first backrest movably interconnected with said seat, wherein said portable seating device is positionable in a stowed position and a deployed position, and wherein said first backrest is selectively movable at least one of toward and away from a reference plane that at least generally contains said seating surface at least when said seating device is in said deployed position;

a second backrest disposed within a perimeter of said first backrest, disposed between said first backrest and a user when sitting on said seat, and selectively movable relative to said first backrest, wherein said first backrest and said second backrest may be collectively moved relative to said seat to change a vertical position of said first and second backrests when said seating device is in said deployed position, and wherein said second backrest further may be moved relative to said first backrest to change a vertical position of said second backrest when said seating device is in said deployed position and without changing a vertical position of said first backrest; and a stand detachably interconnected with said seat assembly, wherein said stand supports said seat assembly above a supporting surface and in spaced relation to said supporting surface when interconnected with said seat assembly, and wherein said portable seating device is configured for a lawn chair like application when said stand is detachably interconnected with said seat assembly.

2. A portable seating device, as claimed in claim 1, wherein:

said second backrest is selectively movable at least one of toward and away from said reference plane at least when said seating device is in said deployed position.

3. A portable seating device, as claimed in claim 1, wherein:

at least one of said first and second backrests is selectively movable at least one of toward and away from a pivotal interconnection that movably interconnects said first backrest and said seat.

4. A portable seating device, as claimed in claim 1, further comprising:

a cover substantially disposed about both said first and second backrests.

5. A portable seating device, as claimed in claim 4, wherein:

said cover comprises means for maintaining a position of said second backrest relative to said first backrest.

6. A portable seating device, as claimed in claim 1, wherein:

said first backrest comprises at least one aperture, wherein at least one fastener associated with said second backrest is extendable through said at least one aperture.

7. A portable seating device, as claimed in claim 6, wherein:

each aperture of said at least one aperture comprises an elongate channel.

8. A portable seating device, as claimed in claim 7, wherein:

said second backrest is movable along said at least one channel and relative to said first backrest.

9. A portable seating device, as claimed in claim 1, wherein:

said first backrest is positionable in first and second positions, wherein, when in said first position, said first backrest is disposed closer to said reference plane than when said first backrest is in said second position.

10. A portable seating device, as claimed in claim 9, wherein:

said second backrest is positionable in third and fourth positions relative to said first backrest.

11. A portable seating device, as claimed in claim 1, further comprising:

a lower frame comprising a pair of first and second frame sections, wherein said pair of first frame sections are fixed to said seat, and wherein each said first frame section has its own said second frame section pivotally interconnected therewith to accommodate movement of said seating device between said stowed position and said deployed position; and an upper frame, wherein said first backrest is mounted on said upper frame, and wherein said upper frame is movably interconnected with said pair of second frame sections to accommodate a change of a vertical position of said first backrest relative to said seat.

12. A portable seating device, as claimed in claim 1, wherein:

said first backrest is detachably interconnected with said seat of said seating device.

13. A portable seating device, as claimed in claim 12, wherein:

said seating device comprises means for enabling detachment said first backrest from said seat by hand.

14. A portable seating device, as claimed in claim 12, wherein:

said first backrest comprises means for releasably interconnecting said first backrest with a separate and distinct seating assembly.

15. A portable seating device, as claimed in claim 14, wherein:

said means comprises at least one strap.

16. A portable seating device, as claimed in claim 1, wherein:

said seat assembly further comprises a base, wherein said stand is detachably interconnected with said base and said seat is rotatably interconnected with said base such that said seat is rotatable relative to said base.

17. A portable seating device, as claimed in claim 1, wherein:

said stand comprises:

a first end detachably interconnectable with said seat assembly;

a second end both spaced from said seat assembly and interfacable with a supporting surface on which said seating device is to be supported when said first end is detachably interconnected with said seat assembly.

18. A portable seating device, as claimed claim 1, wherein said stand remains stationary when interconnected with said seat assembly.

19. A portable seating device, comprising:

a seat assembly comprising a rotatable seat;

a first backrest that is disposable in multiple positions relative to said seat to vary a location above said seat where said first backrest will support a user's back;

a second backrest disposed within a perimeter of said first backrest, disposed between said first backrest and a user when sitting on said seat, and selectively movable relative to said first backrest, wherein said first backrest and said second backrest may be collectively moved relative to said seat to change a vertical position of said first and second backrests relative to said seat, and wherein said second backrest further may be moved relative to said first backrest to change a vertical position of said second backrest relative to said seat and without changing a vertical position of said first backrest relative to said seat; and a stand detachably interconnected with said seat assembly, wherein said stand supports said seat assembly above a supporting surface and in spaced relation to said supporting surface when interconnected with said seat assembly, and wherein said portable seating device is configured for a lawn chair like application when said stand is detachably interconnected with said seat assembly.

20. A portable seating device, as claimed in claim 19, wherein:

at least one of said first and second backrests is selectively movable at least one of toward and away from a pivotal interconnection that movably interconnects said first backrest and said seat.

21. A portable seating device, as claimed in claim 19, further comprising:

a cover substantially disposed about both said first and second backrests.

22. A portable seating device, as claimed in claim 21, wherein:

said cover comprises means for maintaining a position of said second backrest relative to said first backrest.

23. A portable seating device, as claimed in claim 19, wherein:

said first backrest comprises at least one aperture, wherein at least one fastener associated with said second backrest is extendable through said at least one aperture.

24. A portable seating device, as claimed in claim 23, wherein:

each aperture of said at least one aperture comprises an elongate channel.

25. A portable seating device, as claimed in claim 24, wherein:

said second backrest is movable along said at least one channel and relative to said first backrest.

26. A portable seating device, as claimed in claim 19, wherein:

said first backrest is positionable in first and second positions, wherein, when in said first position, said first backrest is disposed closer to a reference plane that contains said seat than when said first backrest is in said second position.

27. A portable seating device, as claimed in claim 26, wherein:

said second backrest is positionable in third and fourth positions relative to said first backrest.

28. A portable seating device, as claimed in claim 19, further comprising:

a lower frame comprising a pair of first and second frame sections, wherein said pair of first frame sections are fixed to said seat, and wherein each said first frame section has its own said second frame section pivotally interconnected therewith to accommodate movement of said seating device between a stowed position and a deployed position; and an upper frame, wherein said first backrest is mounted on said upper frame, and wherein said upper frame is movably interconnected with said pair of second frame sections to accommodate a change of a vertical position of said first backrest relative to said seat.

29. A portable seating device, as claimed in claim 19, wherein:

said first backrest is detachably interconnected with said seat of said seating device.

30. A portable seating device, as claimed in claim 29, wherein:

said seating device comprises means for enabling detachment of said first backrest from said seat by hand.

31. A portable seating device, as claimed in claim 29, wherein:

said first backrest comprises means for releasably interconnecting said first backrest with a separate and distinct seating assembly.

32. A portable seating device, as claimed in claim 31, wherein:

said means comprises at least one strap.

33. A portable seating device, as claimed in claim 19, wherein:

said seat assembly further comprises a base, wherein said stand is detachably interconnected with said base and said seat is rotatably interconnected with said base such that said seat is rotatable relative to said base.

34. A portable seating device, as claimed in claim 19, wherein:

said stand comprises:

a first end detachably interconnectable with said seat assembly;

a second end both spaced from said seat assembly and interfacable with a supporting surface on which said seating device is to be supported when said first end is detachably interconnected with said seat assembly.

35. A portable seating device, comprising:

a seat assembly comprising a rotatable seat;

a lower frame section disposable in a fixed position relative to said seat;

an upper frame section movably interconnected with said lower frame section, wherein a position of said upper frame section relative to said lower frame section may be changed while said lower frame section is disposed in said fixed position relative to said seat;

a first backrest interconnected with said upper frame section;

a second backrest disposed within a perimeter of said first backrest, disposed between said first backrest and a user when sitting on said seat, and selectively movable relative to said first backrest, wherein said first backrest and said second backrest may be collectively moved relative to said seat by moving said upper frame section relative to said lower frame section and which changes a vertical position of said first and second backrests relative to said seat, and wherein said second backrest further may be moved relative to said first backrest to change a vertical position of said second backrest relative to said seat and without changing a vertical position of said first backrest relative to said seat; and a stand detachably interconnected with said seat assembly, wherein said stand supports said seat assembly above a supporting surface and in spaced relation to said supporting surface when interconnected with said seat assembly, and wherein said portable seating device is configured for a lawn chair like application when said stand is detachably interconnected with said seat assembly.

36. A portable seating device, as claimed in claim 35, wherein:

said lower frame section comprises a pair of first sections and a pair of second sections, wherein each said first section is retained in a fixed position relative to said seat, wherein each said second section is pivotally interconnected with its corresponding said first section and is disposable in a fixed position relative to its corresponding said first section after being pivoted into a deployed position, and wherein said upper frame section is movably interconnected with said pair of second sections.

37. A portable seating device, as claimed in claim 35, wherein:

said upper frame section is completely removable from said lower frame section, wherein said first backrest may be used independently of said portable seating device.

38. A portable seating device, as claimed in claim 35, wherein:

said upper frame section telescopingly engages with said lower frame section.

* * * * *